US009915184B2

(12) United States Patent
Han et al.

(10) Patent No.: US 9,915,184 B2
(45) Date of Patent: Mar. 13, 2018

(54) WASTE HEAT EXCHANGER

(71) Applicant: Industrial Technology Research Institute, Hsinchu (TW)

(72) Inventors: Wei-Kuo Han, Hsinchu (TW); Chun-Kai Liu, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 669 days.

(21) Appl. No.: 14/571,118

(22) Filed: Dec. 15, 2014

(65) Prior Publication Data

US 2016/0053653 A1 Feb. 25, 2016

(30) Foreign Application Priority Data

Aug. 20, 2014 (TW) ..... 103128603 A

(51) Int. Cl.
*F28D 21/00* (2006.01)
*F01N 5/02* (2006.01)
(Continued)

(52) U.S. Cl.
CPC ..... *F01N 5/025* (2013.01); *F28D 7/10* (2013.01); *F28D 21/0003* (2013.01); *F28F 1/04* (2013.01); *F28F 1/40* (2013.01); *F28F 1/42* (2013.01)

(58) Field of Classification Search
CPC ... F01N 5/02; F01N 5/025; F28D 1/04; F28D 1/40; F28D 1/42; F28D 7/10
(Continued)

(56) References Cited

U.S. PATENT DOCUMENTS 5,238,057 A 8/1993 Schelter et al.
8,201,615 B2 6/2012 Soukhojak et al.
(Continued)

FOREIGN PATENT DOCUMENTS

CN 1853337 A 10/2006
CN 102434256 A 5/2012
(Continued)

OTHER PUBLICATIONS

Chien-Chou Weng et al., "A Simulation Study of Automotive Waste Heat Recovery Using a Thermoelectric Power Generator," International Journal of Thermal Sciences, Sep. 2013, pp. 302-309, vol. 71, Elsevier, US.

(Continued)

*Primary Examiner* — Jianying Atkisson
*Assistant Examiner* — Antonio R Febles

(57) ABSTRACT

A waste heat exchanger may include an inner tube, an outer tube, a fin assembly and a plurality of heat electric modules The inner tube has a plurality of holes. Disposed inside the inner tube is a plurality of inlet channels and a plurality of outlet channels. The plurality of inlet channels and the plurality of outlet channels are disposed to correspond to each other. The plurality of inlet channels and the plurality of outlet channels are connected to the plurality of holes. A fluid flows through the plurality of inlets and the plurality of holes to get into the outlet channels. The outer tube is disposed outside the inner tube. The conductive assembly is positioned between the inner tube and the outer tube. The conductive assembly is disposed on an outside surface of the inner tube and an inside surface of the outer tube.

17 Claims, 20 Drawing Sheets

(51) Int. Cl.

| | |
|---|---|
| ***F28F 1/40*** | (2006.01) |
| ***F28F 1/42*** | (2006.01) |
| ***F28D 7/10*** | (2006.01) |
| ***F28F 1/04*** | (2006.01) |

(58) Field of Classification Search
USPC ..... 165/109.1, 132, 146, 147, 157, 179
See application file for complete search history.

(56) References Cited

U.S. PATENT DOCUMENTS

| | | | | |
|---|---|---|---|---|
| 8,646,261 | B2 * | 2/2014 | Meisner | H01L 35/30 136/205 |
| 9,145,812 | B2 * | 9/2015 | An | F01N 5/025 |
| 9,293,680 | B2 * | 3/2016 | Poliquin | H01L 35/30 |
| 2005/0204733 | A1 * | 9/2005 | Sasaki | F01N 3/2013 60/320 |
| 2005/0217714 | A1 * | 10/2005 | Nishijima | F01N 5/025 136/204 |
| 2006/0179820 | A1 * | 8/2006 | Sullivan | F01N 3/18 60/275 |
| 2010/0043415 | A1 * | 2/2010 | Capelle | F28D 7/106 60/320 |
| 2010/0154396 | A1 * | 6/2010 | Hahnl | F01N 5/025 60/320 |
| 2012/0042640 | A1 * | 2/2012 | Limbeck | F01N 5/025 60/320 |
| 2012/0222845 | A1 * | 9/2012 | Kinder | F28F 13/12 165/154 |
| 2013/0000285 | A1 * | 1/2013 | Prior | B23K 1/0012 60/320 |
| 2013/0146263 | A1 * | 6/2013 | Kim | F28D 7/0041 165/155 |
| 2013/0152561 | A1 * | 6/2013 | An | F01N 5/025 60/320 |
| 2013/0152562 | A1 * | 6/2013 | An | F01N 5/025 60/320 |
| 2013/0167517 | A1 * | 7/2013 | Dupmeier | F01K 23/065 60/324 |
| 2015/0243866 | A1 * | 8/2015 | Iriyama | F01N 5/025 60/320 |
| 2015/0325767 | A1 * | 11/2015 | Himmer | F01N 5/02 136/208 |
| 2016/0146083 | A1 * | 5/2016 | Lang | F01N 5/025 60/320 |

FOREIGN PATENT DOCUMENTS

| | | | |
|---|---|---|---|
| CN | 202940753 | U | 5/2013 |
| CN | 103166529 | A | 6/2013 |
| EP | 1967806 | A1 | 9/2008 |
| JP | 2000018095 | A | 1/2000 |
| JP | 2006083725 | A | 3/2006 |
| JP | 2008223758 | A | 9/2008 |
| JP | 2013-38219 | | 2/2013 |
| JP | 2013031268 | A | 2/2013 |
| JP | 2013-126370 | A | 6/2013 |
| JP | 2013147974 | A | 8/2013 |
| JP | 2014-051891 | A | 3/2014 |
| TW | M248227 | | 10/2004 |
| TW | M353992 | | 4/2009 |
| TW | 201246776 | | 11/2012 |
| TW | I404903 | | 8/2013 |
| TW | 201341648 | | 10/2013 |

OTHER PUBLICATIONS

C.Q. Su et al., "Acoustic Optimization of Automotive Exhaust Heat Thermoelectric Generator," Journal of Electronic Materials, Jun. 2012, pp. 1686-1692, vol. 41, Issue 6, Springer, US.

Chuqi Su et al., "Effect of the Sequence of the Thermoelectric Generator and the Three-Way Catalytic Converter on Exhaust Gas Conversion Efficiency," Journal of Electronic Materials, Jul. 2013, pp. 1877-1881, vol. 42, Issue 7, Springer, US.

Andreas Bauknecht et al., "Analysis of Annular Thermoelectric Couples with Nonuniform Temperature Distribution by Means of 3-D Multiphysics Simulation," Journal of Electronic Materials, Jul. 2013, pp. 1641-1646, vol. 42, Issue 7, Springer, US.

Y.D. Deng et al., "Thermal Optimization of the Heat Exchanger in an Automotive Exhaust-Based Thermoelectric Generator," Journal of Electronic Materials, Jul. 2013, pp. 1634-1640, vol. 42, Issue 7, Springer, US.

Sumeet Kumar et al., "Thermoelectric Generators for Automotive Waste Heat Recovery Systems Part II: Parametric Evaluation and Topological Studies," Journal of Electronic Materials, Jun. 2013, pp. 944-955, vol. 42, Issue 6, Springer, US.

Taiwan Patent Office, Office Action, Patent Application Serial No. 103128603, dated Aug. 19, 2015, Taiwan.

China Patent Office, Office Action, Patent Application Serial No. 201410604097.7, dated Apr. 12, 2017, China.

* cited by examiner

WASTE HEAT EXCHANGER

CROSS REFERENCE TO RELATED APPLICATIONS

This application is based upon and claims the benefit of priority from the prior Taiwan Patent Application No. 103128603, filed on Aug. 20, 2014, the entire contents of which are incorporated herein by reference.

BACKGROUND

Technical Field

The present disclosure relates to a heat exchanger, and more particularly to a waste heat exchanger.

Description of the Related Art

Generally, an exhaust pipe waste heat exchanger comprises a cuboid, the inside of which is provided with a plurality of parallel fins. The fins are provided with a hemisphere recess to increase a contact area. Waste heat gas through the fins transmits the waste heat to the surface of the outer tube by serial flow type from the inlet to outlet. The waste heat gas flows downstream with the airflow. The temperature is gradually decreased on the surface of the outer tube. The temperature difference between the upstream side and the downstream side is too large when disposed thermoelectric modules are mounted. The temperature difference may achieve 100° C. on the surface of the outer tube of the exhaust pipe waste heat exchanger.

SUMMARY

A waste heat exchanger is disclosed. The waste heat exchanger may include an inner tube, an outer tube, a fin assembly and a plurality of heat electric modules. The inner tube has a plurality of holes. Disposed inside the inner tube is a plurality of inlet channels and a plurality of outlet channels. The plurality of inlet channels and the plurality of outlet channels are disposed to correspond to each other. The plurality of inlet channels and the plurality of outlet channels are both connected to the plurality of holes. A fluid flowing through the plurality of inlet and the plurality of holes to get into the outlet channels. The outer tube disposed on outside of the inner tube. The conductive assembly positioned between the inner tube and the outer tube. The conductive assembly is disposed on an outside surface of the inner tube and an inside surface of the outer tube.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

Figure 1:
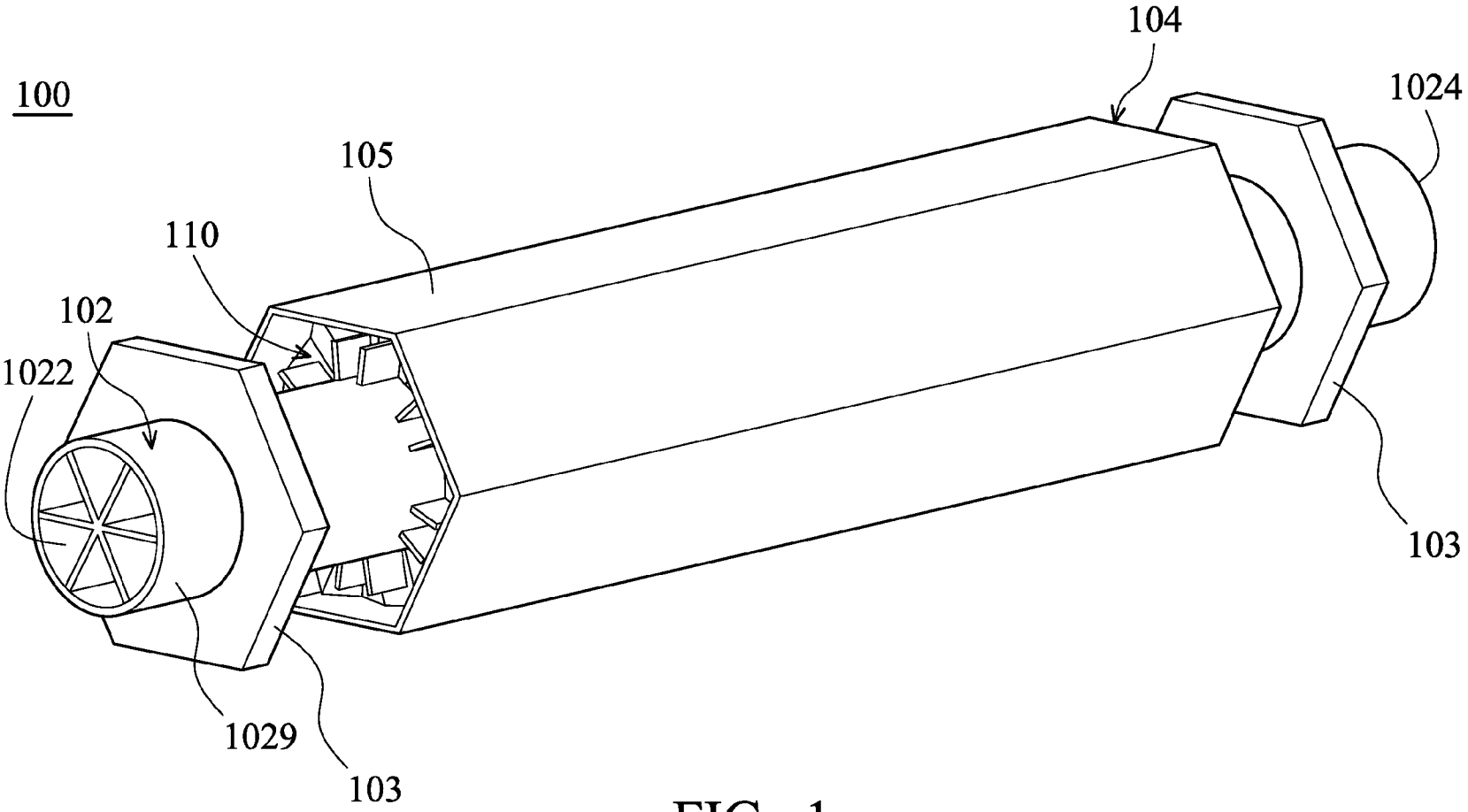
FIG. 1 is a schematic view showing partial decomposition of a waste heat exchanger of the present disclosure.
Figure 2A:
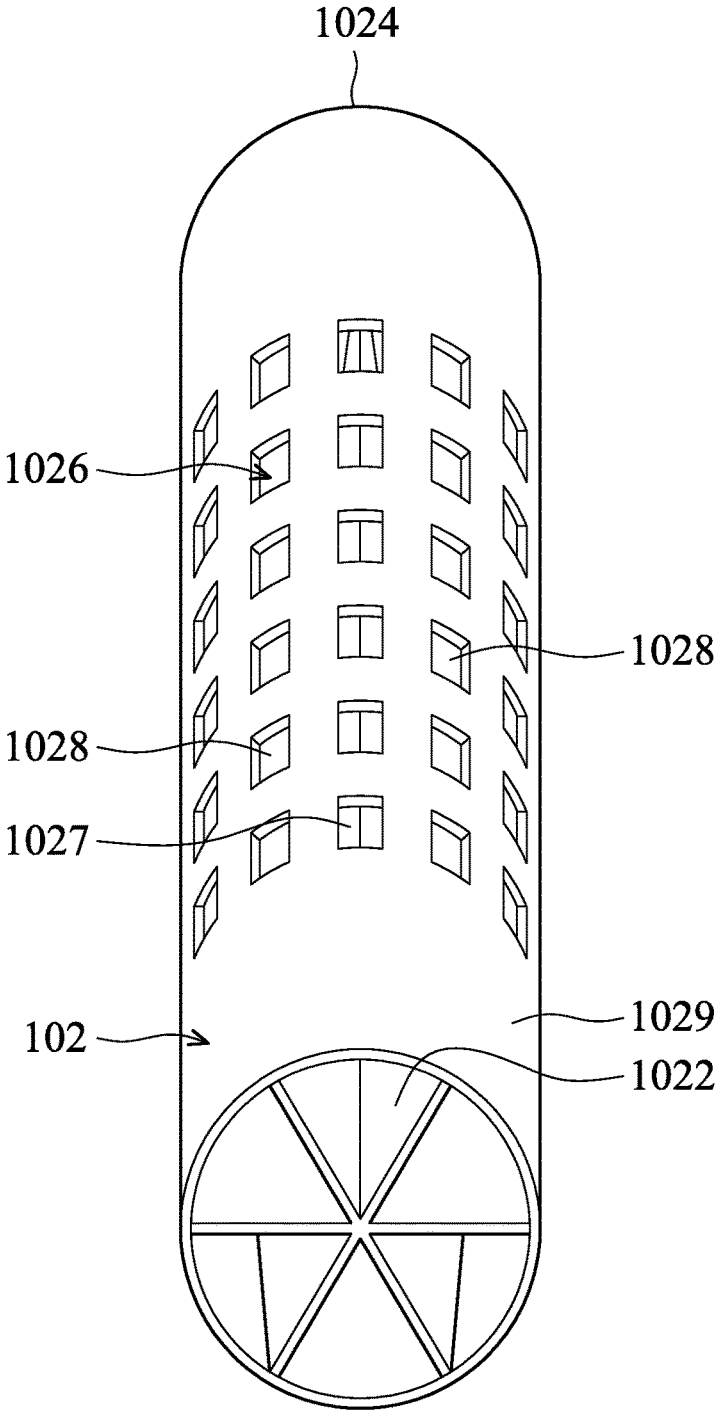
FIG. 2A is a schematic view of an inner tube of the waste heat exchanger of the present disclosure.
Figure 2B:
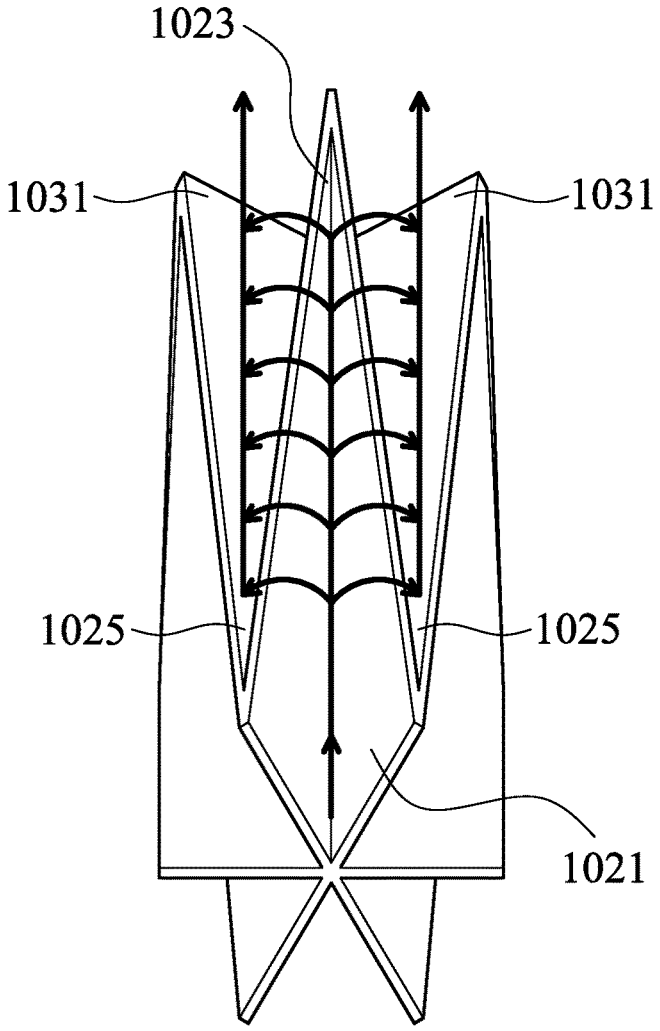
FIG. 2B is a schematic view of an inlet channel and an outlet channel of the waste heat exchanger of the present disclosure.

Referring to FIGS. 1, 2A, and 2B, a waste heat exchanger 100 of the disclosure includes an inner tube 102 and an outer tube 104. The inner tube 102 has a plurality of inlet channels 1022 and a plurality of outlet channels 1024 to allow fluid carrying waste heat to enter through the inlet channels 1022 and drain through the outlet channels 1024. A tubular body of the inner tube 102 has a plurality of holes 1026 and a plurality of inlet channel 1022 and a plurality of outlet channel 1024 of the inner tube 102 may use the plurality of holes 1026 to communicate with each other. Therefore, the fluid carrying the waste heat may enter the plurality of holes 1026 through the plurality of inlet channels 1022 and drain through the plurality of outlet channels 1024. The flow carrying the waste heat may include a gas and/or a liquid. In an embodiment, for example, the waste heat exchanger is an exhaust tube, but not limited thereto. Other structures of the same spirit are included in the scope of the spirit of the present disclosure. As shown in FIG. 2A, when the fluid carrying the waste heat flow from the inner tube 102 via the plurality of holes 1026 into the outer tube 104, the fluid carrying the waste heat may contact a surface of the outer tube 104 with a conductive assembly 110 so that the thermal energy of the fluid is transmitted outward from the interior of the outer tube 104 to an outer surface 105 of the outer tube 104 to be for example, dissipated to the surrounding air. Or alternatively, the waste heat can be taken away by another fluid (for example, air and liquid), or be converted into other forms of energy for recovery and reuse.

In one embodiment, the outer tube 104 is not provided with a thermoelectric module. The waste heat is dissipated from the fluid to the outside by mean of natural convection.

As shown FIG. 1, Each of two ends of the outer tube 104 is disposed with a sealing element 103 to seal the outer tube 104 avoid flow leakage.

In one embodiment, the conductive assembly 110 may be a fin assembly, but not limited thereto. For example, a conductive sheet and the likes are considered within the spirit of the present disclosure.

Figure 3A:
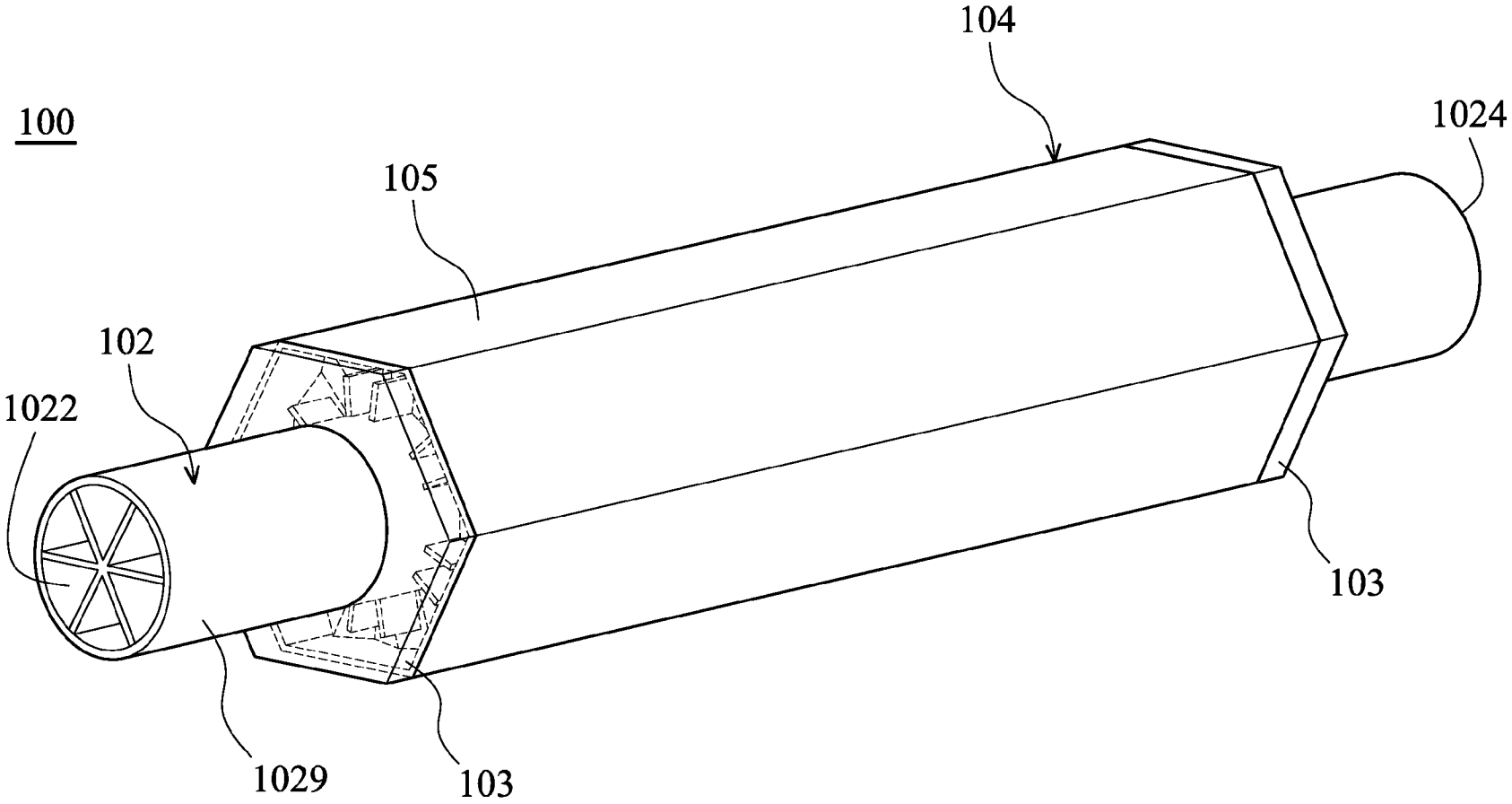
FIG. 3A is a schematic view of a natural convection type waste heat exchanger of the present disclosure.

Referring to FIGS. 2A and 2B, the plurality of inlet channels 1022 and the plurality of outlet channels 1024 are arranged to coaxially corresponding each other. The fluid carrying the waste heat may enter the plurality of inlet channels 1022, flowing through the plurality of holes 1026, and exit the plurality of outlet channels 1024. In the process, the fluid carrying the waste heat may contact the body of the outer tube 104, so as to transmit the waste heat to the outer tube 104. The plurality of holes 1026 are composed of a plurality of inlet holes 1027 and a plurality of outlet holes 1028. The plurality of inlet holes 1027 may communicate with the plurality of inlet channels 1022. The plurality of outlet holes 1028 communicate with the plurality of outlet channels 1024. Referring to FIG. 3A, two ends of the outer tube 104 are disposed with a sealing element 103 to seal the outer tube 104 so as to avoid flow leakage. The two ends of the outer tube 104 are respectively fixed to the sealing elements 103. The outer tube 104 is in contact with the surrounding air to dissipate the waste heat.

Figure 3B:
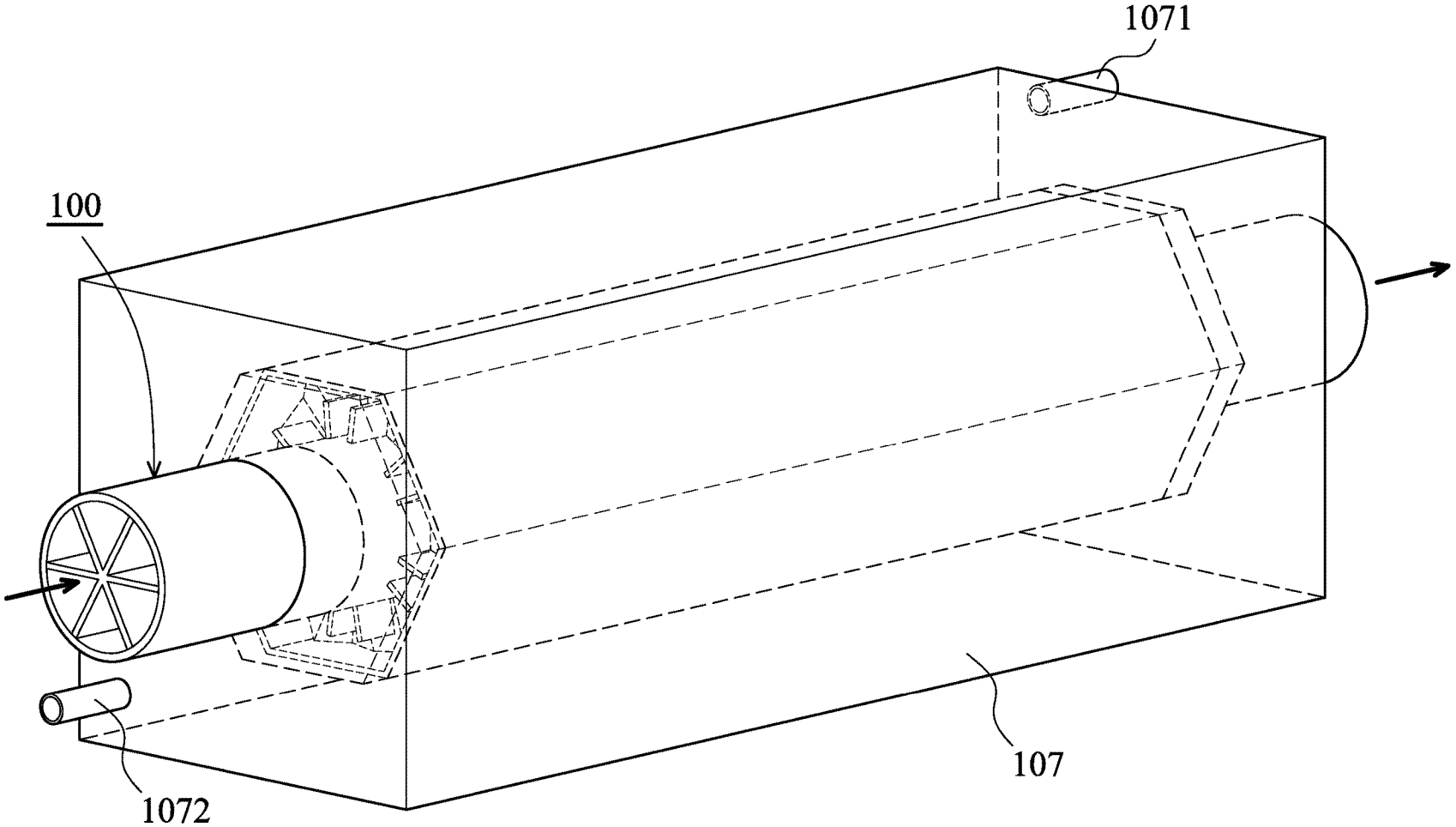
FIG. 3B is a schematic view illustrating waste heat being taken away by outside fluid.

Referring to FIG. 3B, the waste heat exchanger 100 is disposed in a box 107. The box 107 has an inlet 1071 and an outlet 1072 provided for ingress and egress of a cooling fluid. The cooling fluid, when entering the box 107 contact the outer tube 104 of the waste heat exchanger 100 to absorb thermal energy so as to increase the temperature of the cooling fluid temperature to thereby take away the thermal energy of the waste heat exchanger 100.

Figure 4:
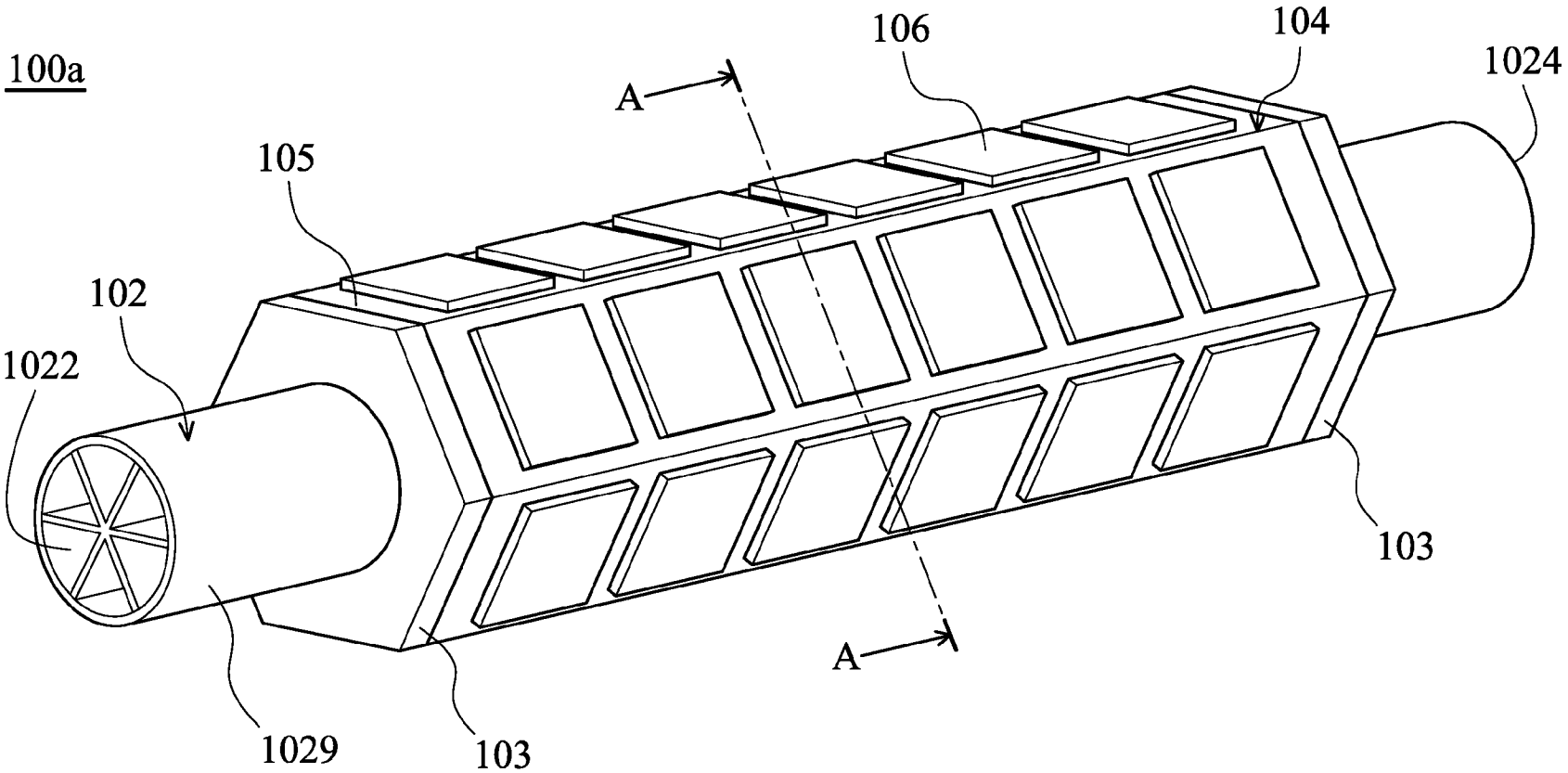
FIG. 4 is a schematic view showing thermoelectric modules attached to the outer tube of a waste heat exchanger according to another embodiment of FIG. 1.

Referring to FIG. 4, the disclosure further may include at least one thermoelectric modules 106 disposed on the outer surface 105 of the outer tube 104. The outer surface 105 of the outer tube 104 comprises one or a plurality of thermoelectric modules 106. The thermoelectric modules 106 can contact the waste heat gas to conduct thermoelectric transform to generate electric energy. The thermoelectric modules 106 may include one or a plurality of thermoelectric chips. When the fluid carrying the waste heat flow through the inner tube 102 via the plurality of holes 1026 into the outer tube 104, the fluid carrying the waste heat may contact a surface of the outer tube 104 with a conductive assembly 110. The heat energy may transmit through the body of the outer tube 104 to the thermoelectric modules 106 disposed on the outer surface 105 of the outer tube 104 to conduct thermoelectric transform to generate electric energy.

In one embodiment, it does not include the thermoelectric modules of the disclosure. The waste heat exchanger 100 may contact air directly to dissipate heat through natural convection.

In another embodiment, it is not included the thermoelectric modules of the disclosure. Through the cooling fluid via the outer surface of the waste heat exchanger 100, the waste heat may take away.

Figure 5A:
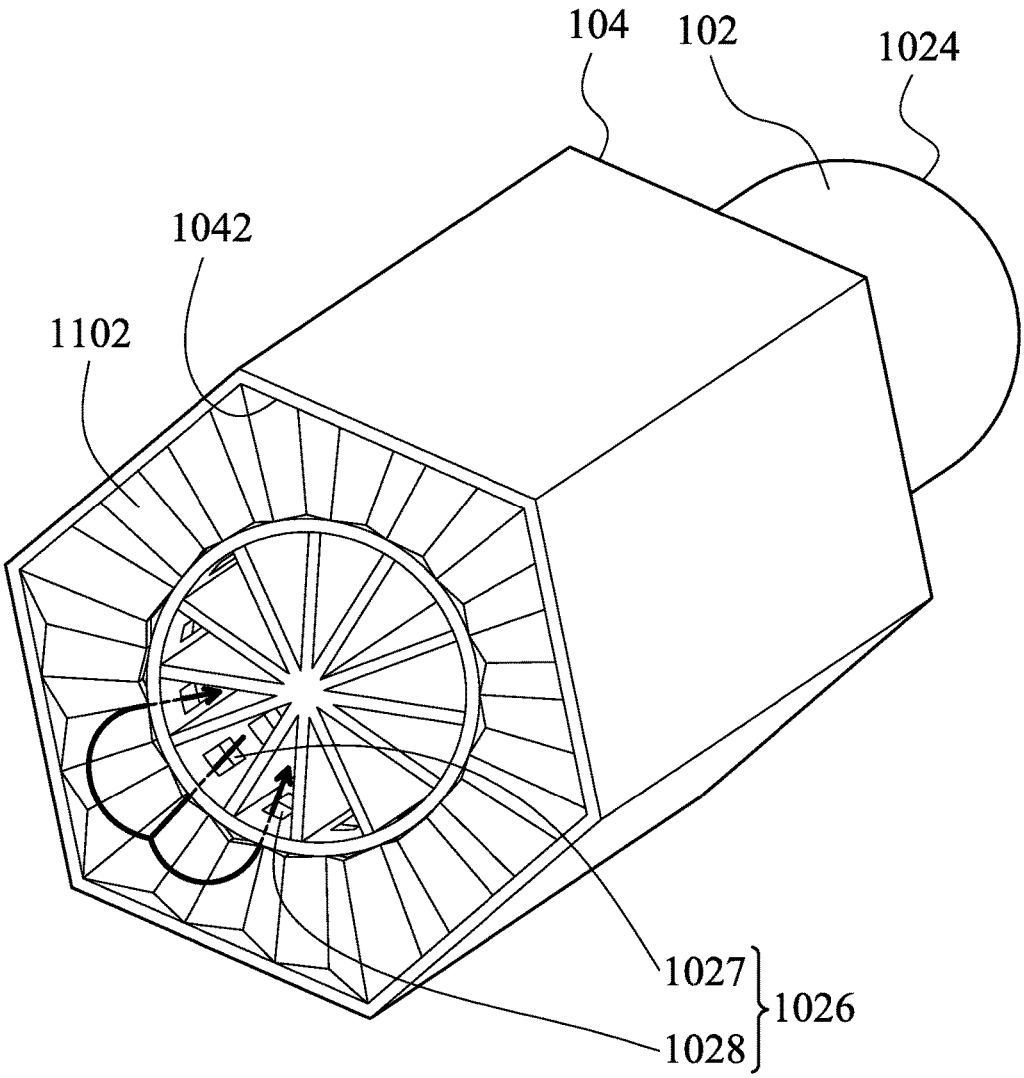
FIG. 5A is a cross-sectional view of a waste heat exchanger along taken along line A-A' of FIG. 4.
Figure 5B:
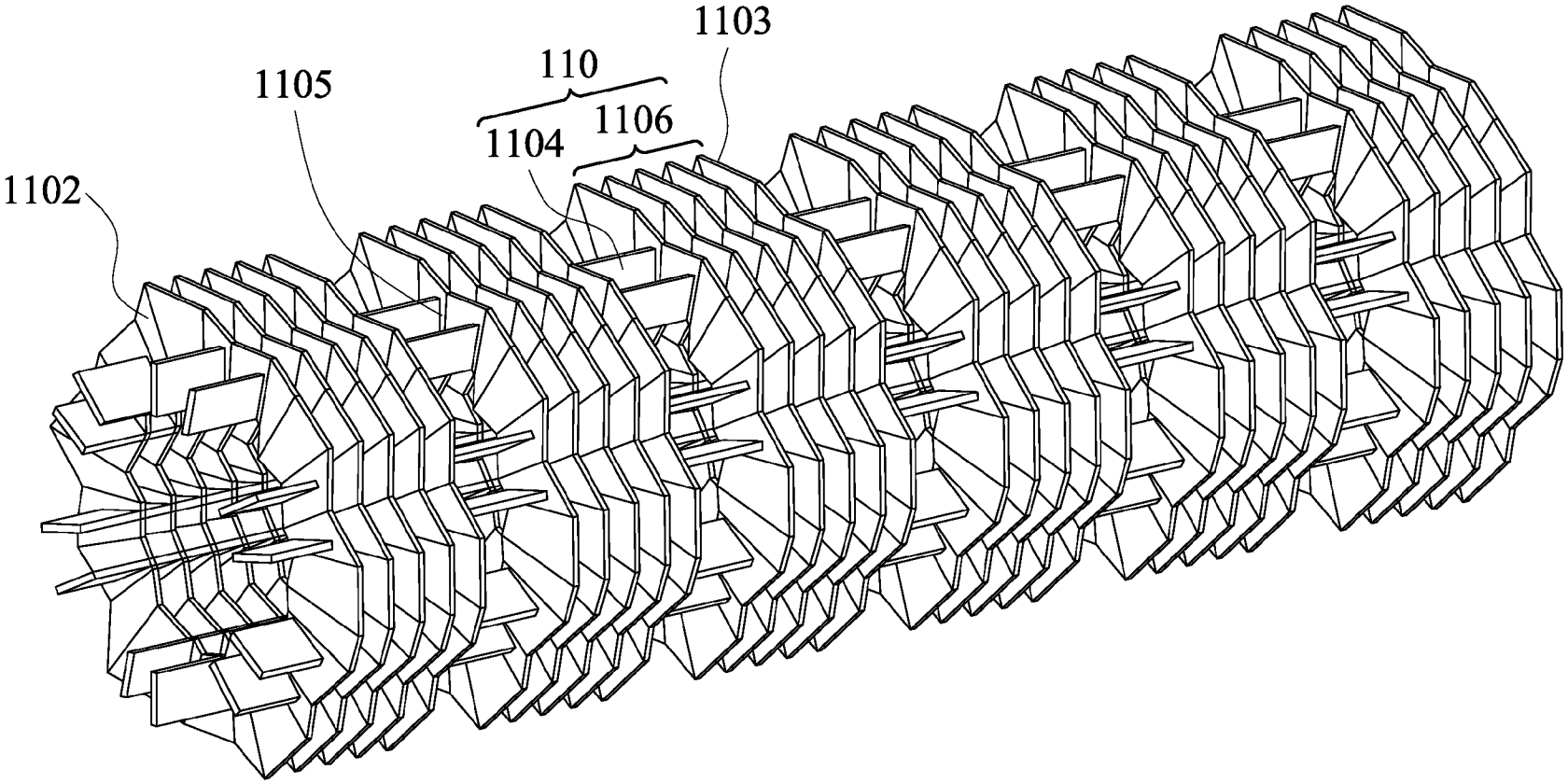
FIG. 5B is a schematic view showing fin assembly of the waste heat exchanger of the present disclosure.

Referring to FIGS. 5A and 5B, in an embodiment, the plurality of holes 1026 of the body of the inner tube 102 are arranged in a plurality of straight lines. The plurality of holes 1026 is arranged in a plurality of rows, as shown in FIG. 2A. Referring to FIG. 5A, in an embodiment, a top of the plurality of inlet channels 1022 is disposed in the inner tube 102, and the body of the inner tube 102 is correspondingly provided with a plurality of holes 1027. It is provided that the waste heat gas enters through the inlet channels 1022 of the inner tube 102. Due to a first end 1021 area (as FIG. 2B shown) of a V shape element (the plurality of inlet channel) being greatest than a second end 1023 area of the V shape element, the fluid carrying the waste heat can naturally flow to the plurality of holes 1027. The fluid carrying the waste heat can enter a space between the inner tube 102 and the outer tube 104. The fluid carrying the waste heat flowed between the conductive assemblies 110. The fluid carrying the waste heat is sufficiently in contact with each fin 1102 of the conductive assembly 110. Then, when the fluid is in contact with the inner surface 1042 of the outer tube 104, the fluid rebounds to the other holes 1028 of two sides of the outer tube 104. A top of the plurality of outlet channels 1024 is disposed in the outer tube 104, and the body of the outer tube 104 is correspondingly provided a plurality of holes 1028. It is provided the waste heat gas drains through the outlet channels 1024 of the outer tube 104. The V shape element is included in numerous embodiments of the plurality of inlet channels 1022 and the plurality of outlet channels 1024, as shown FIG. 2B.

In an embodiment, a first end of the plurality of inlet channel 1022 is a V-shape structure, and a second end of the plurality of inlet channel 1022 is a tip structure. The plurality of the inlet channels 1022 may be gradually reduced channels. A first end of the plurality of outlet channels 1024 is a tip structure, and a second end of the plurality of outlet channels 1024 is a V-shape structure. So, the plurality of outlet channels 1024 may be gradually enlarged channels. Therefore, the plurality of inlet channel 1022 and the plurality of outlet channel 1024 have the following structure. Each inlet channel 1022 includes a first end 1021 and a second end 1023. The first end 1021 area of inlet channel 1022 is greater than the second end 1023 area of the inlet channel 1024. Each outlet channel 1024 includes a first end 1025 and a second end 1031. The first end 1025 area of outlet channel 1024 is smaller than the second end 1031 area of the outlet channel 1024.

In one embodiment, due to each inlet channel 1022 being a V-shape structure, so that the first end 1021 of the inlet channel 1022 is gradually reduced from the first end 1021 of the inlet channel 1022 to the second end 1023 of the inlet channel 1022, and each outlet channel 1024 is a V-shape structure, the first end 1025 of the outlet channel 1024 is gradually enlarged from the first end 1025 of the outlet channel 1024 to the second end 1031 of the outlet channel 1024. The first end 1021 of the inlet channel 1022 is connected to the first end 1025 of the outlet channel 1024, and the second end 1023 of the inlet channel 1022 is connected to the second end 1031 of the outlet channel 1024. The V-shape structure of the inlet channel 1022 is spaced at interval to connect the V-shape structure of the outlet channel 1024 each other. The inlet channel 1022 and outlet channel 1024 are separated.

Referring to FIGS. 5A and 5B shown, a conductive assembly 110 is disposed between the inner tube 102 and the outer tube 104. The conductive assembly 110 is disposed on an outer surface of the body of the inner tube 102 and an inside surface of the body of the outer tube 104. The conductive assembly 110 may be a fin assembly, or include an equivalent structure. The fin assembly 110 includes a plurality of fixed elements 1104 and a plurality of fin structures 1106; the plurality of fin structures 1106 is disposed on the plurality of fixed elements 1104; and the fixed element 1104 has a plurality of embedded slots 1105 to fix the fin structure 1106. The fixed element 1104 may be a sheet structure. The embedded slots 1105 may be a comb structure. The embedded slots 1105 has a plurality of notches, and the plurality of notch may fix the plurality of fin structure 1106 respectively. In one embodiment, the waste heat exchanger 100 may be of a hexagonal shape, so that the fin structure 1106 may be of a hexagonal shape.

In one embodiment, the inner tube 102 may be a round shape, and the outer tube 104 may be a hexagonal.

In one embodiment, each fin structure 1106 includes a plurality of fins 1103, and the fins may be of a wave-shape to increase contact with areas. The fluid carrying the waste heat may contact with a surface of the fins 1103. The heat energy transmits to the outer surface 105 of the outer tube 104 by the fins 1103, and then the heat energy transmits to the plurality of thermoelectric modules 106.

In one embodiment, two ends of the fixed element 1104 are disposed on the outside surface 1029 of the inner tube 102; the fin structure 1106 are positioned at two ends of the fixed element 1104; the fin structure 1106 is fixed on the inside surface 1042 of the outer tube 104. Generally, the fins 1103 can be used in a welding type to achieve the fins 1103 being fixed on the outer tube 104.

Figure 6:
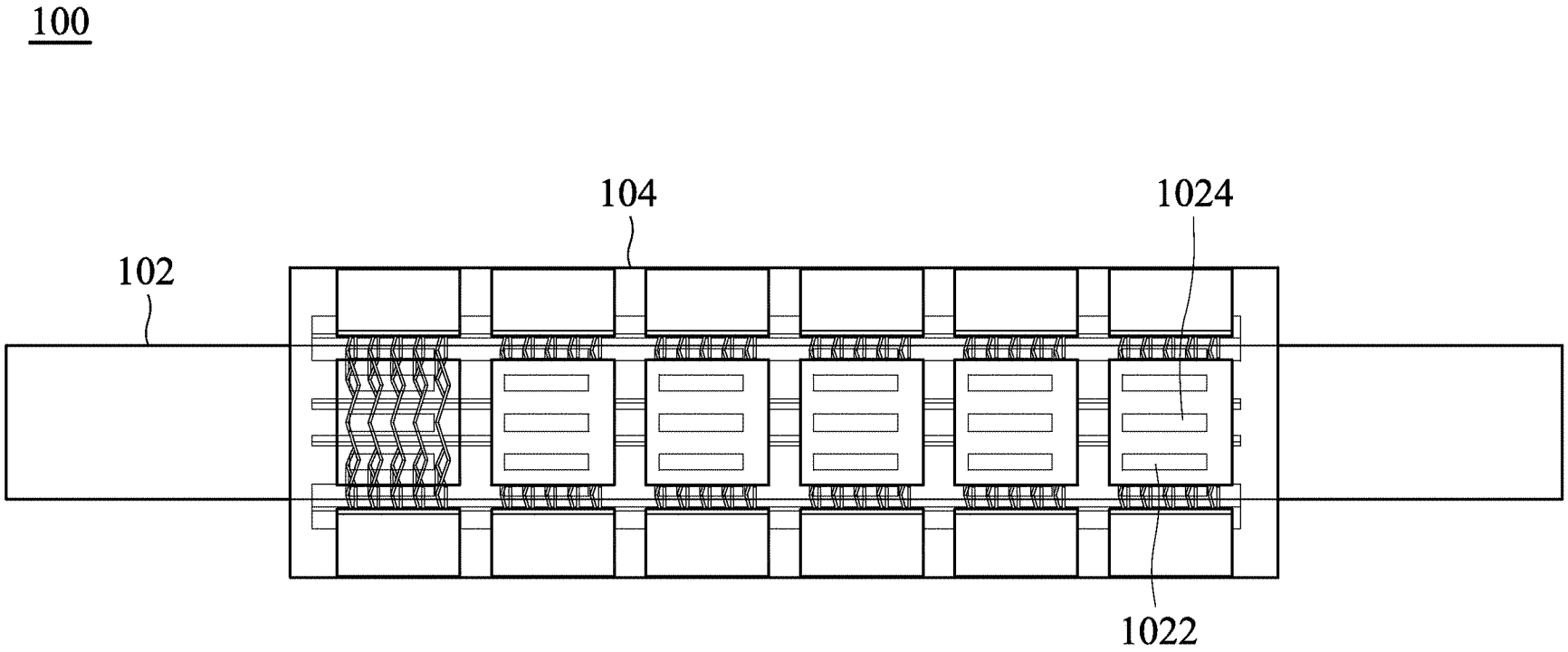
FIG. 6 is a partial cross-sectional view of a waste heat exchanger of the present disclosure.

Referring to FIG. 6, in an embodiment, the waste heat exchanger 100 of the disclosure may be hexagonal. As shown in FIG. 6, the waste heat exchanger 100 is ⅙ of the hexagonal waste heat exchanger. In one embodiment, the design of the outer tube 104 is about 320 mm. The hexagonal waste heat exchanger 100 is designed with six inlets and six outlets. So, the inlet channels 1022 may be six, and the outlet channel 1024 may be six. FIG. 6 shows ⅙ inlet channel 1022 and ⅙ outlet channel 1024 of the hexagonal waste heat exchanger 100.

Figure 7:
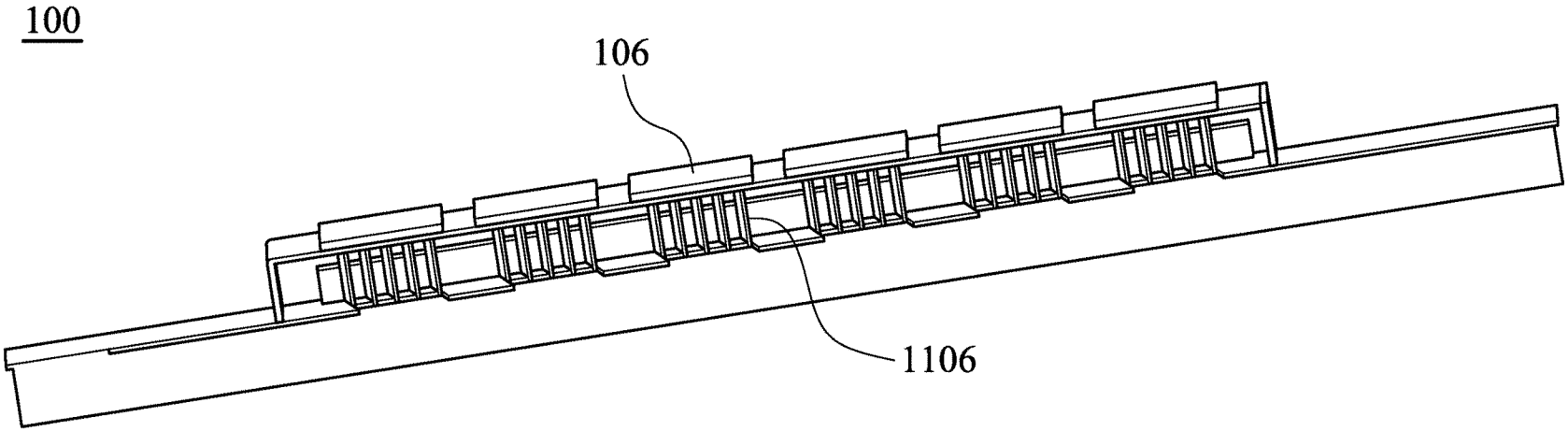
FIG. 7 is a ⅙ cross section of a waste heat exchanger of the present disclosure.

Referring to FIG. 7, in an embodiment, it is used ⅙ of the hexagonal waste heat exchanger 100 to simulate the temperature. The thermoelectric modules 106 are correspondingly disposed on the top of the fin structure 1106. In one embodiment, the thermoelectric modules 106 are 4×4 cm, and, in total, six thermoelectric modules are used to go on simulation.

Figure 8:
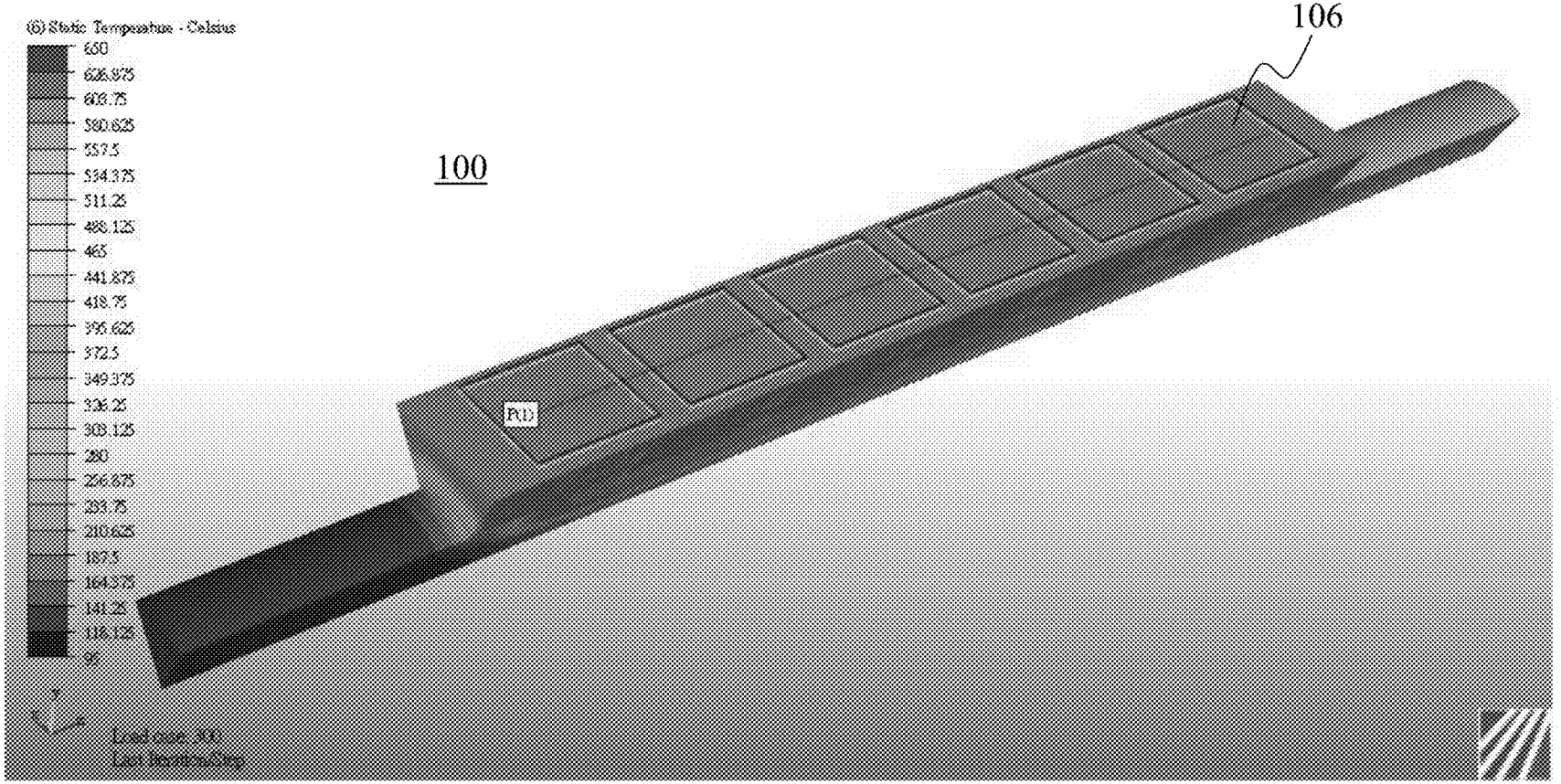
FIG. 8 is a plot showing surface temperature of FIG. 7.

Referring to FIG. 8, in an embodiment, it shows ⅙ of the hexagonal waste heat exchanger 100 to shows its temperature distribution state. An inlet temperature of the simulation condition is 650° C. The waste heat gas of fluid is about 0.117 kg/s. A cool end of the thermoelectric modules (TE) 106 is 95° C. to serve as a simulation cool side.

Figure 9:
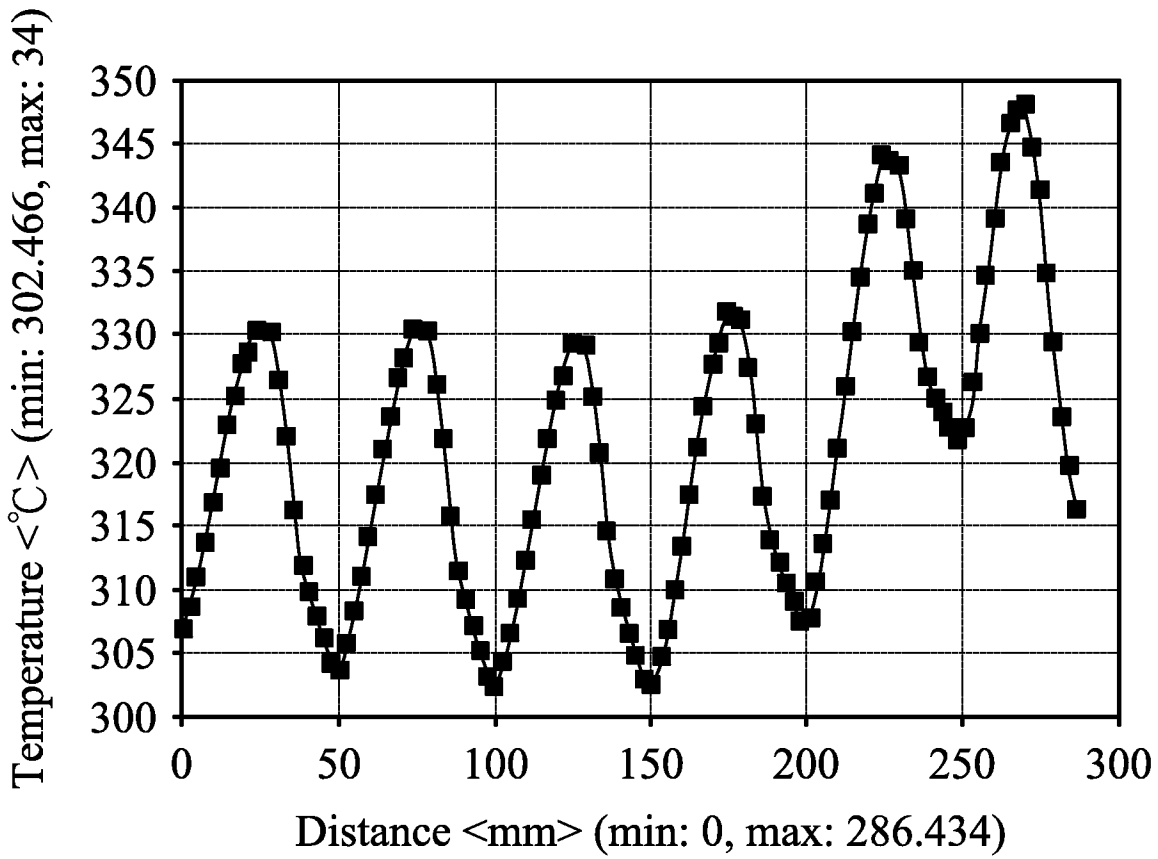
FIG. 9 is a curve diagram of the surface temperature of the outer tube of FIG. 8.

Referring to FIG. 9, in an embodiment, the simulation result shows the surface temperature of the hexagonal waste heat exchanger 100, in average, is about 320° C., and it has 30° C. temperature difference diversification.

Figure 10:
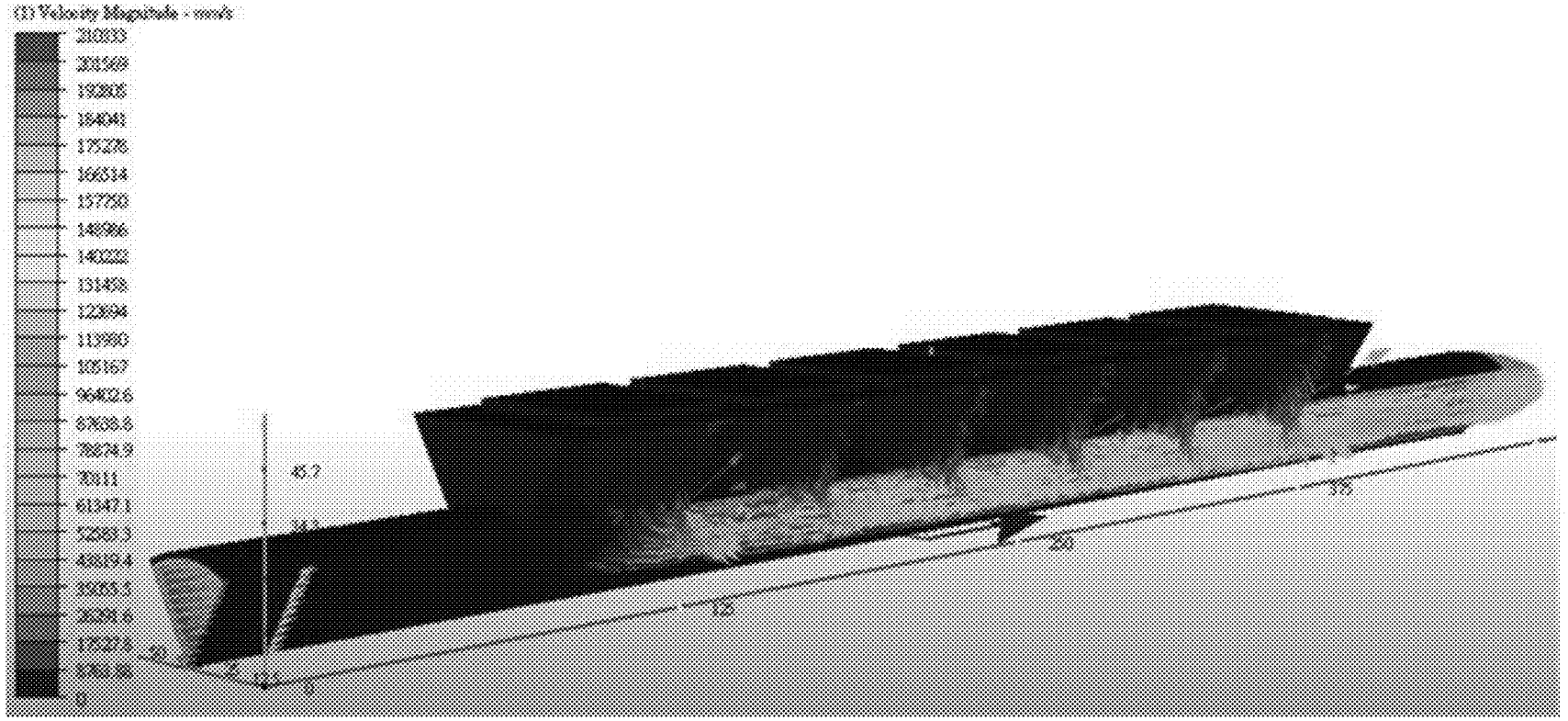
FIGS. 10 and 11 are an airflow simulation result of FIG. 7.
Figure 11:
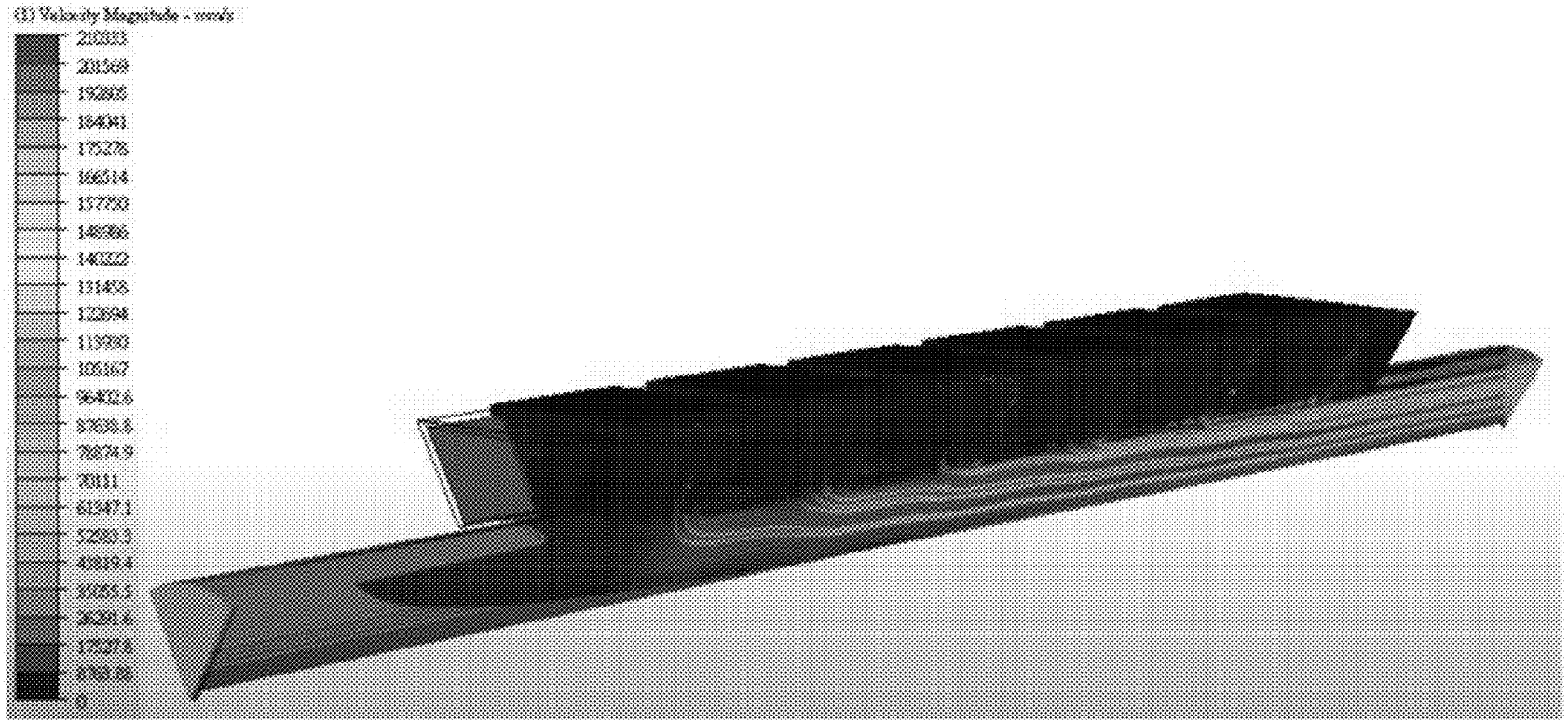

Referring to FIGS. 10 and 11 shown, in an embodiment, it shows a center airflow vector distribution and a track route of the hexagonal waste heat exchanger 100. It shows the fluid carrying the waste heat average and being contacted with the fins.

Figure 12:
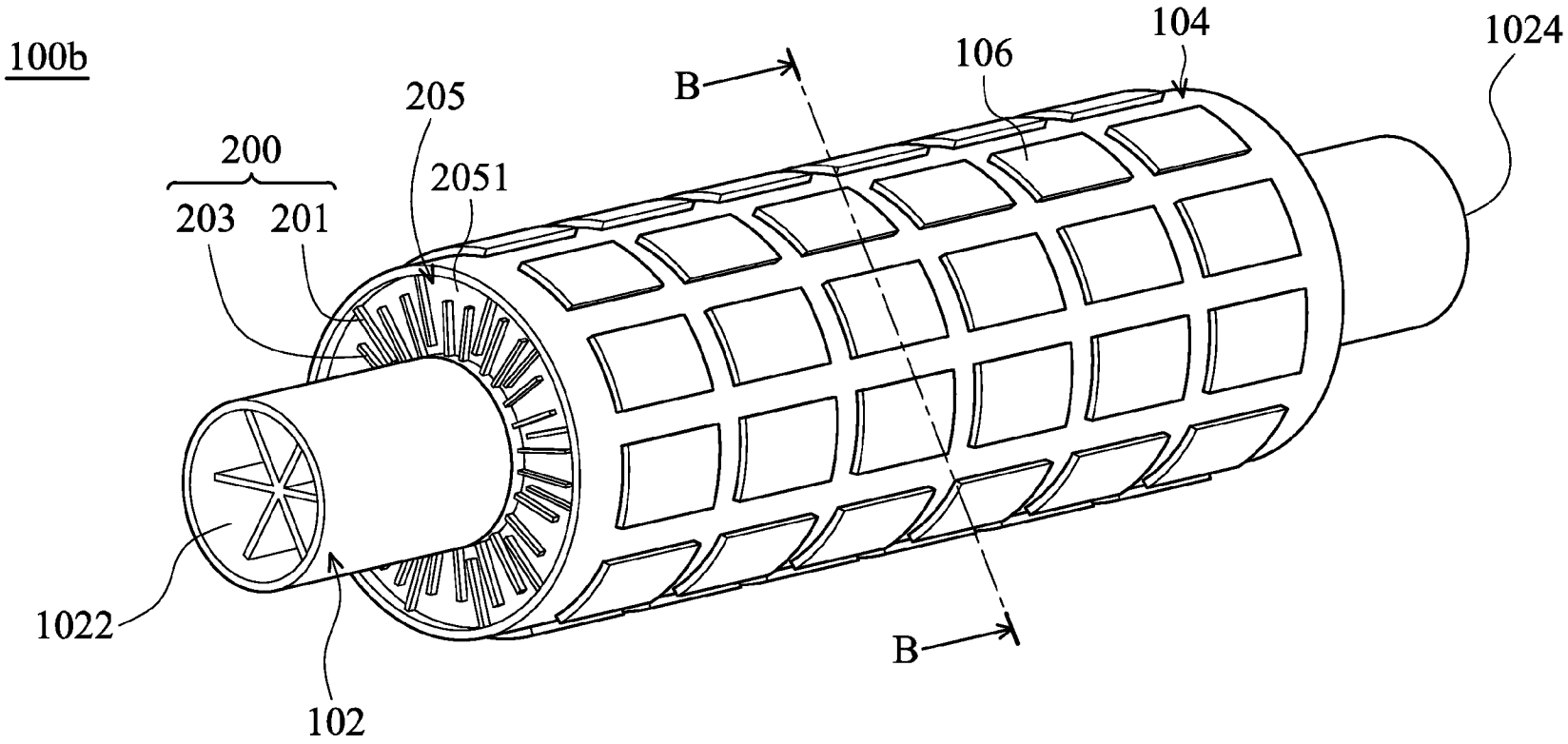
FIG. 12 is a schematic view of a waste heat exchanger according to another embodiment of the present disclosure.

Referring to FIG. 12, the present embodiment and aforementioned embodiments are the same structure. It is different that the outer tube 104 may be a round, the fins 1103 are a round, and the inner tube 102 is round.

Figure 13:
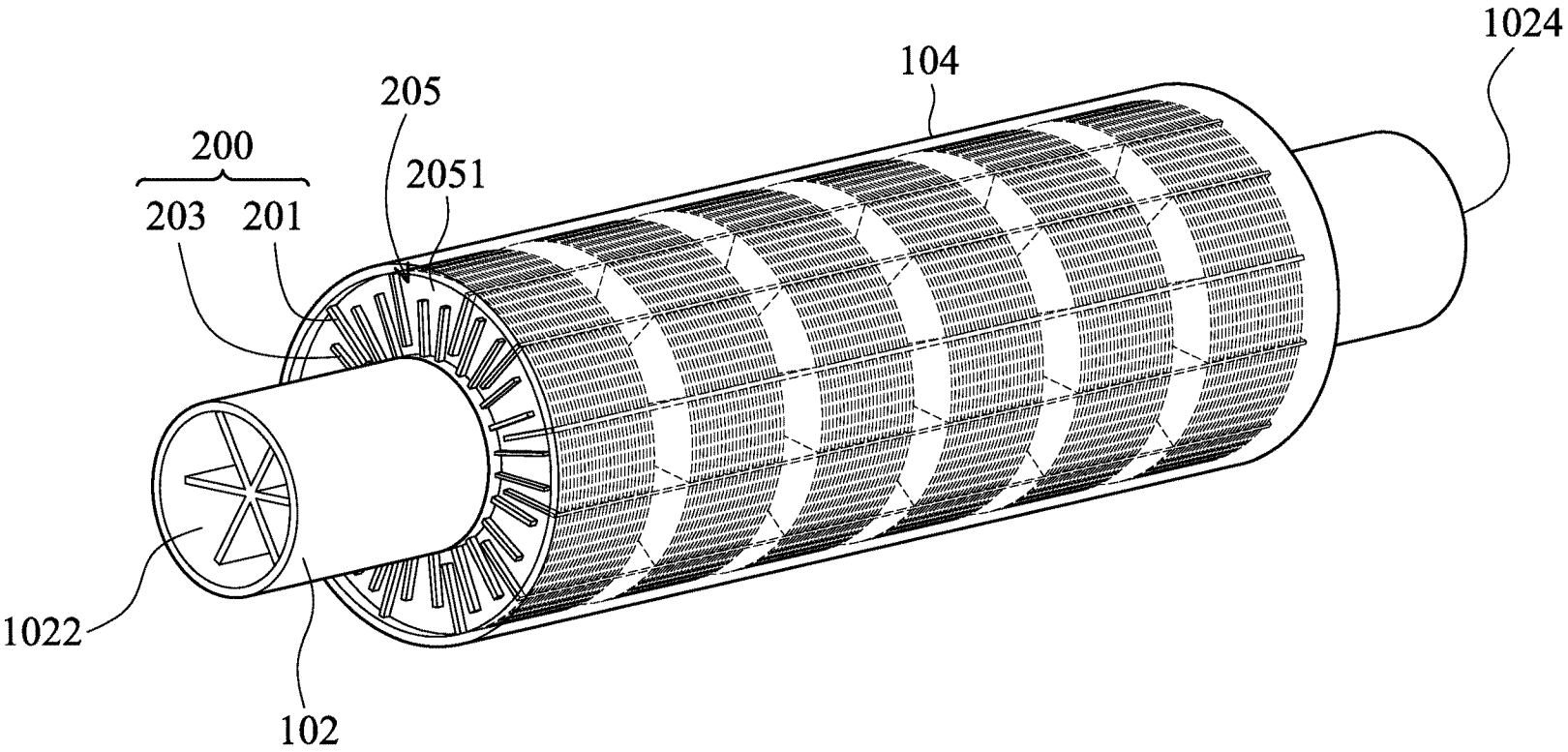
FIG. 13 is a schematic view of FIG. 12, wherein the thermoelectric modules of the outer tube are not drawing omission.

Referring to FIG. 13, the present embodiment and aforementioned embodiments are of the same structure. It is different that the plurality of fixed elements 200 includes a first fixed element 201 and a second fixed element 203; the first fixed element 201 has a plurality of first embedded slots (figure is not shown) to fix an outer edge part of the each fin structure 205; and the second fixed element 203 has a plurality of second embedded slots (figure is not shown) to fix an inner edge part of the each fin structure 205.

In one embodiment, the each fin structure 205 includes a plurality of fins 2051, and the fins 2051 is a wave-shape.

The first fixed element 201 is disposed on the inner surface of the outer tube 104, and the second fixed element 203 is disposed on the outer surface of the inner tube 102.

Figure 14:
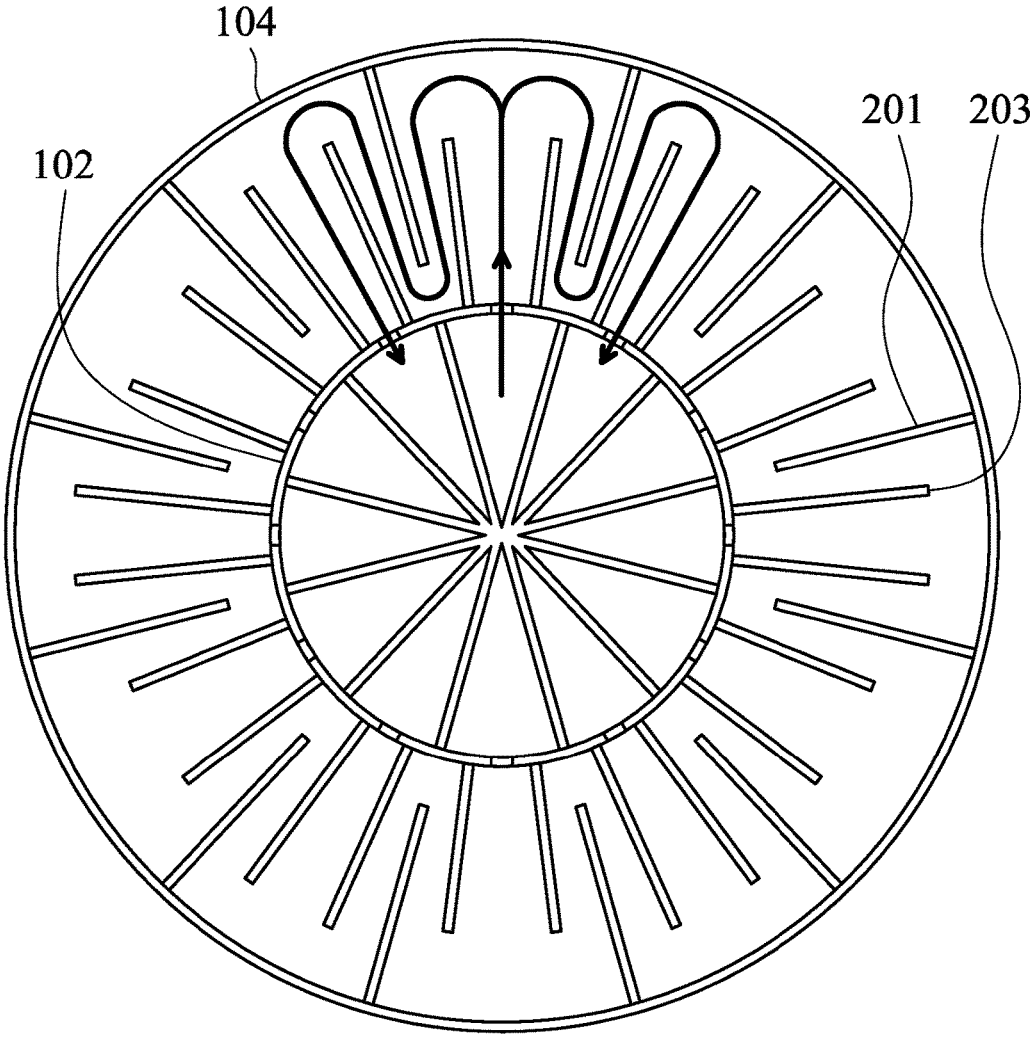
FIG. 14 is a cross-sectional view of the waste heat exchanger taken along line B-B of FIG. 12.

In an embodiment, the first fixed element 201 has 12 pieces to fix the plurality of fin structure 205. The second fixed element 203 has 24 pieces to fix the plurality of fin structure 205. Therefore, between two pieces of the first fixed element 201, two pieces of the second fixed element 203 are disposed. As shown in FIG. 14, a flow direction of the fluid carrying the waste heat may be shown by arrow. Through the inlet channel 1022 fluid enters via the holes 1027 of the inner tube 102 forward outside to flow, and the waste heat is in contact with the surface of the fin structure 205 of the conductive assembly 110 and outer tube 104 to transmit the heat energy. Through the conductive assembly 110, the heat energy transmits to thermoelectric modules 106 of the outer surface 105 of the outer tube 104 to go on thermoelectric transform to generate electric energy. The waste heat gas through the inner surface of the outer tube 104 rebounded and to flow between the first fixed element 201 and the second fixed element 203 from the holes 1028 into the outlet channel 1024 to exhaust.

Figure 15:
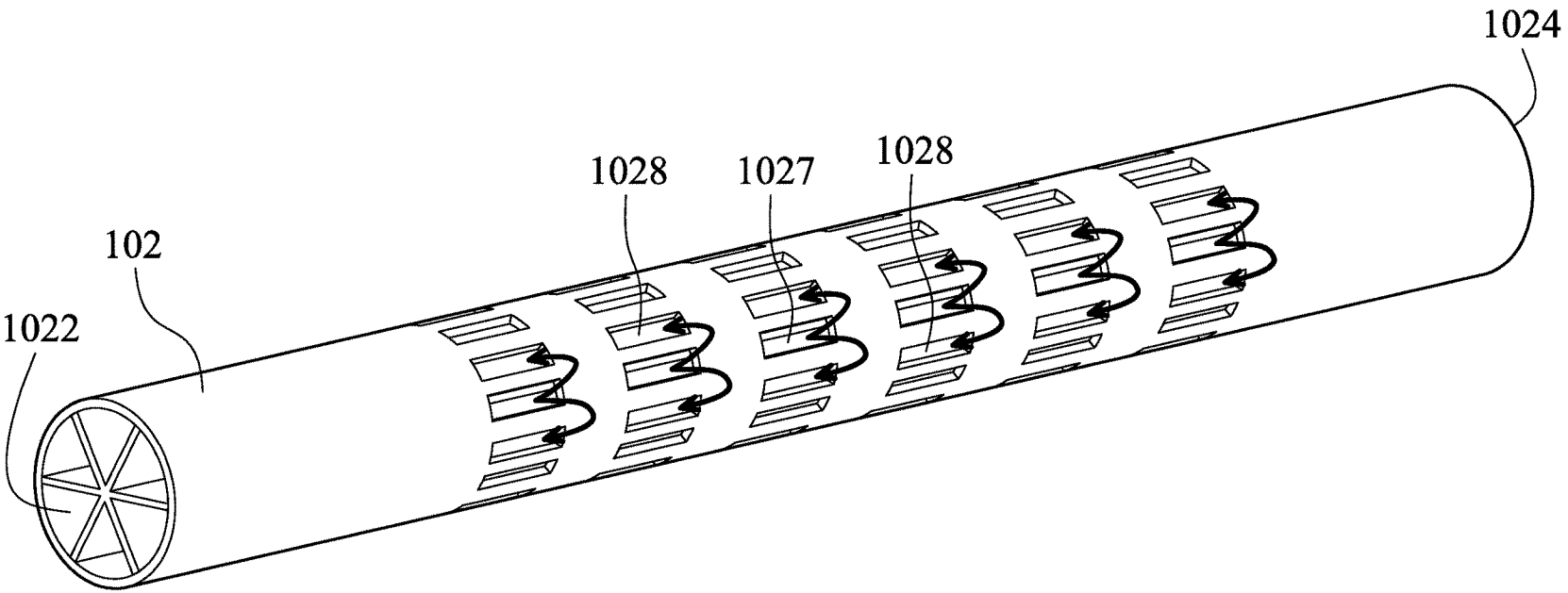
FIG. 15 is a schematic view illustrating airflow route of the inner tube of FIG. 12.
Figure 16A:
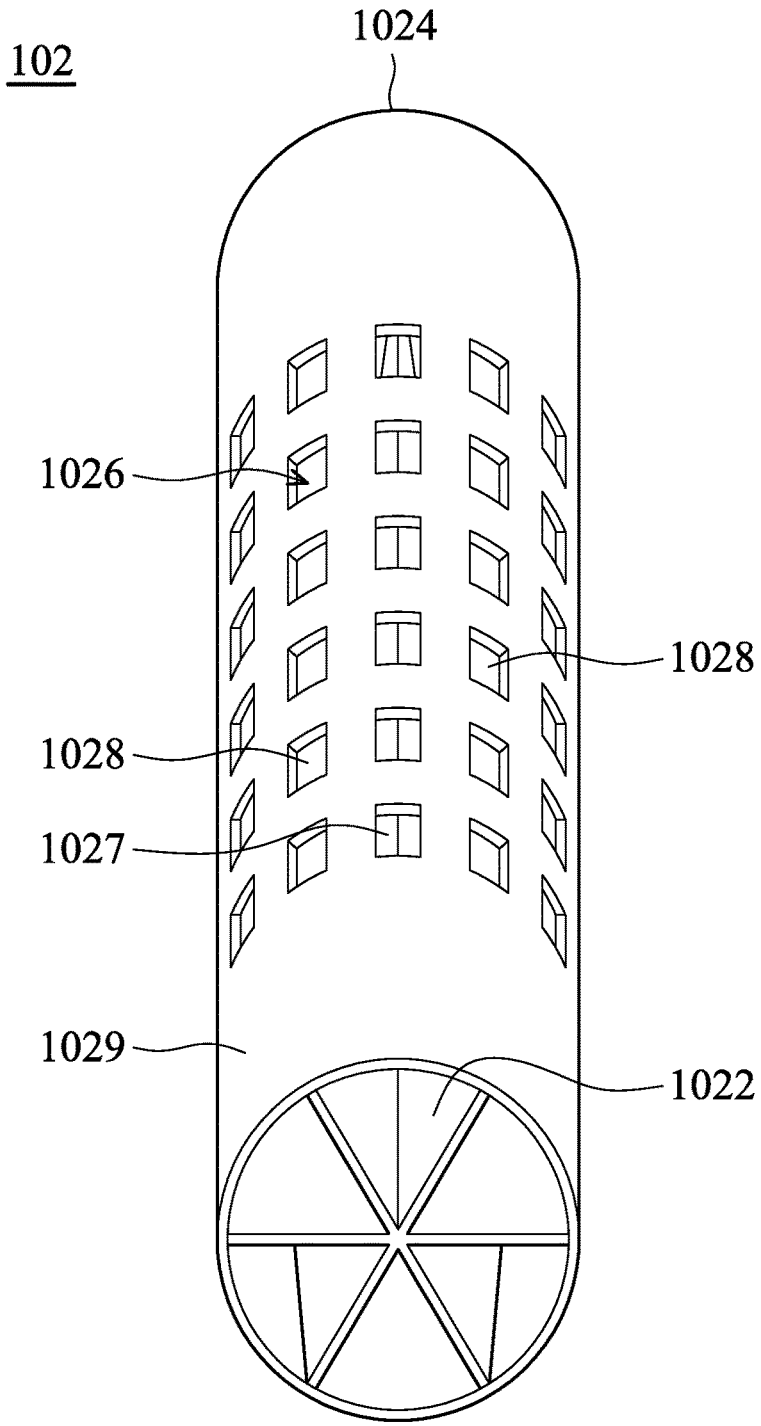
FIG. 16A is a schematic view of the inner tube of FIG. 12.
Figure 16B:
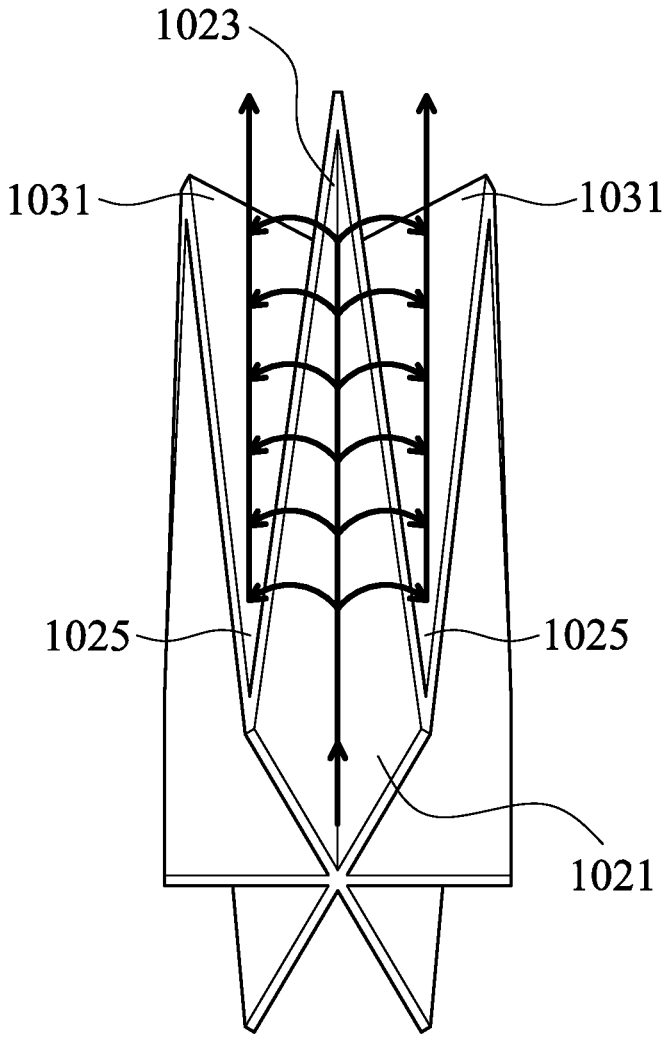
FIG. 16B is a schematic view illustrating of the inlet channels and the outlet channels of FIG. 12.

Referring to FIGS. 15, 16A, and 16B, the fluid carrying the waste heat may pass through the plurality of inlet channel 1022 to enter via the plurality of holes 1026 forward outside, through the inner surface of the outer tube 104 rebounded and enter corresponding the holes 1028 of the outer channel 1024 to exhaust.

In summary, the disclosure waste heat exchanger may achieve each thermoelectric module average to obtain heat quantity and temperature distribution, The upstream and downstream of the surface of the pipe may be temperature difference smaller than 30° C. For the thermoelectric modules may increase to generate electric energy performance to obtain higher effect electric energy in power supply management. It may reduce power loss.

It will be apparent to those skilled in the art that various modifications and variations can be made to the structure of the application without departing from the scope or spirit of the application. In view of the foregoing, it is intended that the application cover modifications and variations of this application provided they fall within the scope of the following claims and their equivalents.

What is claimed is:

1. A waste heat exchanger, comprising:

an inner tube having a plurality of holes, wherein disposed in the inside of the inner tube is a plurality of inlet channels and a plurality of outlet channels, the plurality of inlet channels and the plurality of outlet channels being disposed to correspond to each other, the plurality of inlet channels and the plurality of outlet channels connected to the plurality of holes, a fluid flowing through the plurality of inlets and the plurality of holes to get into the outlet channels;

an outer tube disposed on an outside surface of the inner tube; and a conductive assembly positioned between the inner tube and the outer tube, the conductive assembly disposed on the outside surface of the inner tube and an inside surface of the outer tube, wherein the conductive assembly comprises a plurality of fin structures.

2. The waste heat exchanger according to claim 1, wherein the plurality of holes is arranged in a plurality of straight lines.

3. The waste heat exchanger according to claim 1, wherein the plurality of holes includes a plurality of inlet holes and a plurality of outlet holes, the plurality of inlet holes communicating with the plurality of inlet channels, the plurality of outlet holes communicating with the plurality of outlet channels.

4. The waste heat exchanger according to claim 3, wherein the inlet channel has a first end and a second end, an area of the first end of the inlet channel is greater than an area of the second end of the inlet channel, the outlet channel having a first end and a second end, and an area of the first end of the outlet channel is smaller than an area of the second end of the outlet channel.

5. The waste heat exchanger according to claim 4, wherein the inlet channel is a V-shaped structure, the inlet channel being gradually reduced from the first end of the inlet channel to the second end of the inlet channel, the outlet channel is a V-shaped structure, the outlet channel is gradually enlarged from the first end of the outlet channel to the second end of the outlet channel; and the first end of the inlet channel is connected to the first end of the outlet channel, the second end of the inlet channel is connected to the second end of the outlet channel, the V-shaped structure of the inlet channel is spaced at an interval to connect the V-shaped structure of the outlet channel to each other.

6. The waste heat exchanger according to claim 1, wherein the conductive assembly is a fin assembly, the fin assembly includes a plurality of fixed elements and the fin structures, the fin structures disposed on the fixed elements; and the fixed element has a plurality of embedded slots to fix the fin structure.

7. The waste heat exchanger according to claim 6, wherein the fin structure includes a plurality of fins, and the fins are wave-shaped.

8. The waste heat exchanger according to claim 6, wherein the fixed element is disposed on the outside surface of the inner tube, the fin assembly is positioned at two ends of the fixed element, and the fin assembly is fixed on the inside surface of the outer tube.

9. The waste heat exchanger according to claim 6, wherein the plurality of fixed elements includes a first fixed element and a second fixed element, the first fixed element having a plurality of first embedded slots to fix an outer edge part of the each fin structure, and the second fixed element having a plurality of second embedded slots to fix an inner edge part of the each fin structure.

10. The waste heat exchanger according to claim 9, wherein the fin structure includes a plurality of fins, and the fins are wave-shaped.

11. The waste heat exchanger according to claim 9, wherein the first fixed element is fixed on the inner surface of the outer tube, and the second fixed element is fixed on the outer surface of the inner tube.

12. The waste heat exchanger according to claim 1, wherein the fluid is a gas or liquid.

13. The waste heat exchanger according to claim 1, wherein the waste heat exchanger is an exhaust pipe waste heat exchanger, the inner tube has a round shape, the outer tube has a hexagonal shape, and the conductive assembly has a hexagonal shape.

14. The waste heat exchanger according to claim 1, wherein the waste heat exchanger is an exhaust pipe waste heat exchanger, the inner tube has a round shape, the outer tube has a round shape, and the conductive assembly has a round shape.

15. The waste heat exchanger according to claim 1, further comprising a plurality of thermoelectric modules disposed on the outer surface of the outer tube.

16. The waste heat exchanger according to claim 1, wherein the waste heat exchanger is disposed on a pipe or in a box in order to take away a waste heat of the waste heat exchanger by a cooling fluid in the pipe or box.

17. A waster heat exchanger, comprising: an inner tube having a plurality of holes, wherein disposed in the inside of the inner tube is a plurality of inlet channels and a plurality of outlet channels, the plurality of inlet channels and the plurality of outlet channels being disposed to correspond to each other, the plurality of inlet channels and the plurality of outlet channels connected to the plurality of holes, a fluid flowing through the plurality of inlets and the plurality of holes to get into the outlet channels;

an outer tube disposed on an outside surface of the inner tube; and a conductive assembly positioned between the inner tube and the outer tube, the conductive assembly disposed on the outside surface of the inner tube and an inside surface of the outer tube.

* * * * *